US007175569B1

(12) United States Patent
Lan et al.

(10) Patent No.: US 7,175,569 B1
(45) Date of Patent: Feb. 13, 2007

(54) SWIMMING EXERCISER

(76) Inventors: Jen-Fan Lan, No. 3, Fuyu 13 St., Hualien (TW); Jenn-Jian Lan, No. 131, Jhongmei Rd., Hualien (TW)

( * ) Notice: Subject to any disclaimer, the term of this patent is extended or adjusted under 35 U.S.C. 154(b) by 0 days.

(21) Appl. No.: 11/254,415

(22) Filed: Oct. 20, 2005

(51) Int. Cl.
*A63B 31/00* (2006.01)

(52) U.S. Cl. ..... 482/55; 482/69; 434/254

(58) Field of Classification Search ..... 482/51, 482/55, 56, 69, 111, 121, 124, 129; 434/254; 119/771, 784; 441/116, 129, 136; 273/DIG. 19
See application file for complete search history.

(56) References Cited

U.S. PATENT DOCUMENTS

| | | | | |
|---|---|---|---|---|
| 793,288 | A * | 6/1905 | Faber | 482/56 |
| 3,445,941 | A * | 5/1969 | Burke et al. | 434/254 |
| 4,095,657 | A * | 6/1978 | Hohwart | 482/55 |
| 4,247,096 | A * | 1/1981 | Schmitt | 482/55 |
| 4,248,419 | A * | 2/1981 | Hohwart | 482/55 |
| 4,527,795 | A * | 7/1985 | Zink | 482/55 |
| 4,530,497 | A * | 7/1985 | Moran et al. | 482/5 |
| 4,577,859 | A * | 3/1986 | Gossett | 482/55 |
| 4,948,118 | A * | 8/1990 | Miraglia | 482/55 |
| 5,938,565 | A * | 8/1999 | Bernacki | 482/57 |
| 6,966,870 | B2 * | 11/2005 | Lan | 482/55 |
| 7,104,932 | B1 * | 9/2006 | Brentlinger | 482/55 |

* cited by examiner

*Primary Examiner*—Jerome Donnelly
*Assistant Examiner*—Tam Nguyen
(74) *Attorney, Agent, or Firm*—Alan D. Kamrath; Nikolai & Mersereau, P.A.

(57) ABSTRACT

A swimming exerciser has a vertical support, an arm, a roller assembly, a resilient element, a belt, a resilient tether and a rope. The vertical support is mounted beside a swimming pool and has a pulley. The arm is hollow and is connect to and protrudes from the vertical support and has a distal end. The roller assembly is mounted moveably inside the arm. The resilient element is mounted inside the arm between the roller assembly the distal end of the arm. The belt is worn around a person's waist. The resilient tether is attached to the roller assembly and the belt and compensates for a swimmer's lack of movement through the water to hold the swimmer at a constant depth. The rope is connected to the roller assembly, reeved through the pulley and connected to the belt to hold a swimmer in a fixed position when swimming.

5 Claims, 4 Drawing Sheets

SWIMMING EXERCISER

BACKGROUND OF THE INVENTION

1. Field of the Invention

The present invention relates to a swimming exerciser, and more particularly to a swimming exerciser that allows a person to swim in a small area of a swimming pool and holds the person in a specific direction.

2. Description of Related Art

Swimming is a very popular low-impact exercise. Swimming develops a person's muscles and cardiovascular and respiratory systems.

Most people swim laps in swimming pools for exercise. However, swimming pools are often crowded, and swimming laps or practicing stroke techniques can be very difficult.

To overcome the shortcomings, the present invention provides a swimming exerciser to obviate or mitigate the aforementioned problems.

SUMMARY OF THE INVENTION

The primary objective of the present invention is to provide a swimming exerciser that allows a person to swim in a small area of a swimming pool and holds the swimmer at a specific depth in the water.

The swimming exerciser has a vertical support, an arm, a roller assembly, a resilient element, a belt, a resilient tether and a rope. The vertical support is mounted beside a swimming pool and has a vertical support pulley. The arm is hollow, is connected to and protrudes out from the vertical support and has a distal end. The roller assembly is mounted moveably inside the arm. The resilient element is mounted inside the arm between the roller assembly the distal end of the arm. The belt is worn around a person's waist. The resilient tether is attached to the roller assembly and the belt and compensates for a swimmer's lack of movement through the water to hold the swimmer at a constant depth. The rope is connected to the roller assembly, reeved through the vertical support pulley and connected to the belt to hold a swimmer in a fixed position when swimming.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
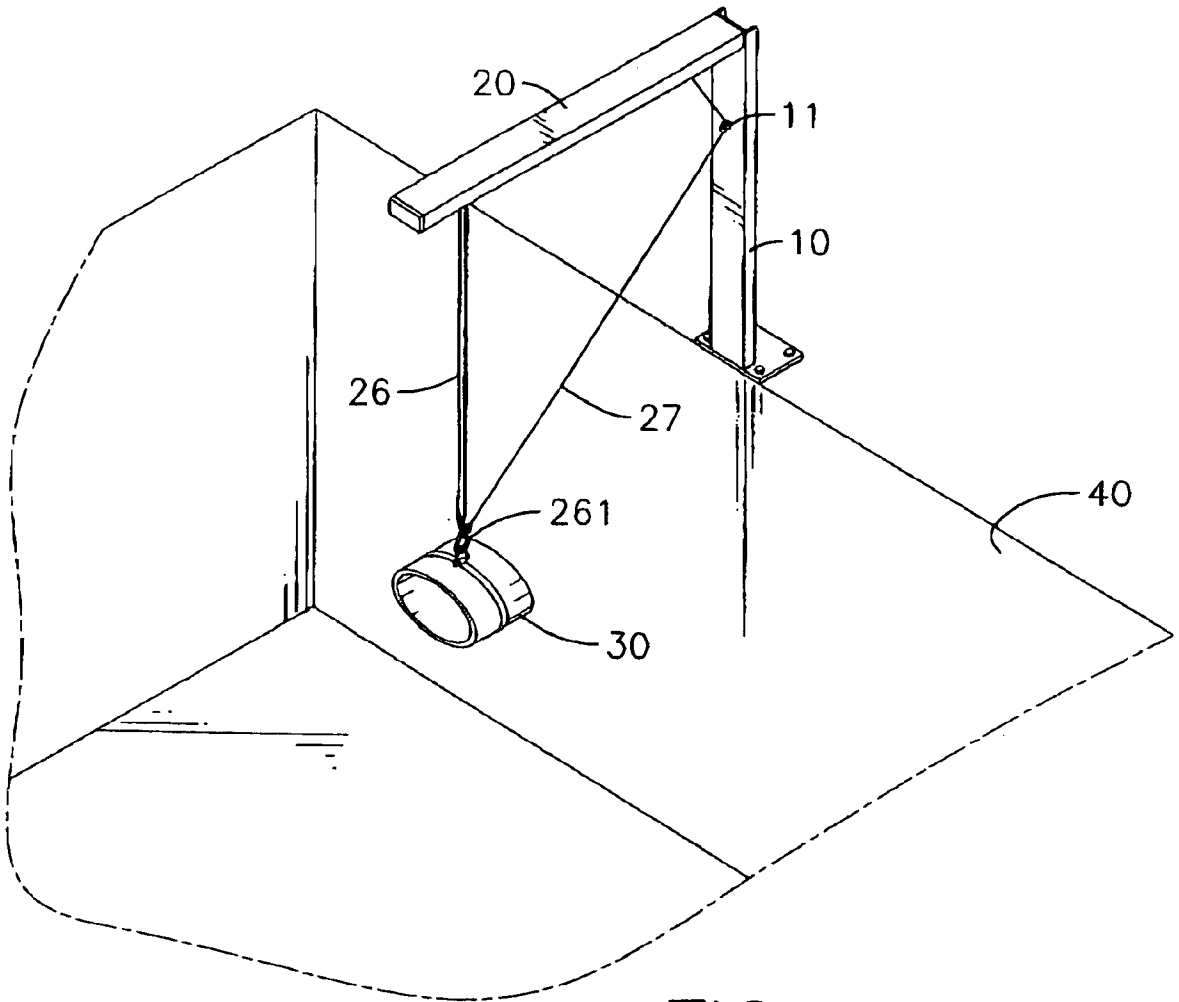
FIG. 1 is a perspective view of a swimming exerciser in accordance with the present invention.
Figure 2:
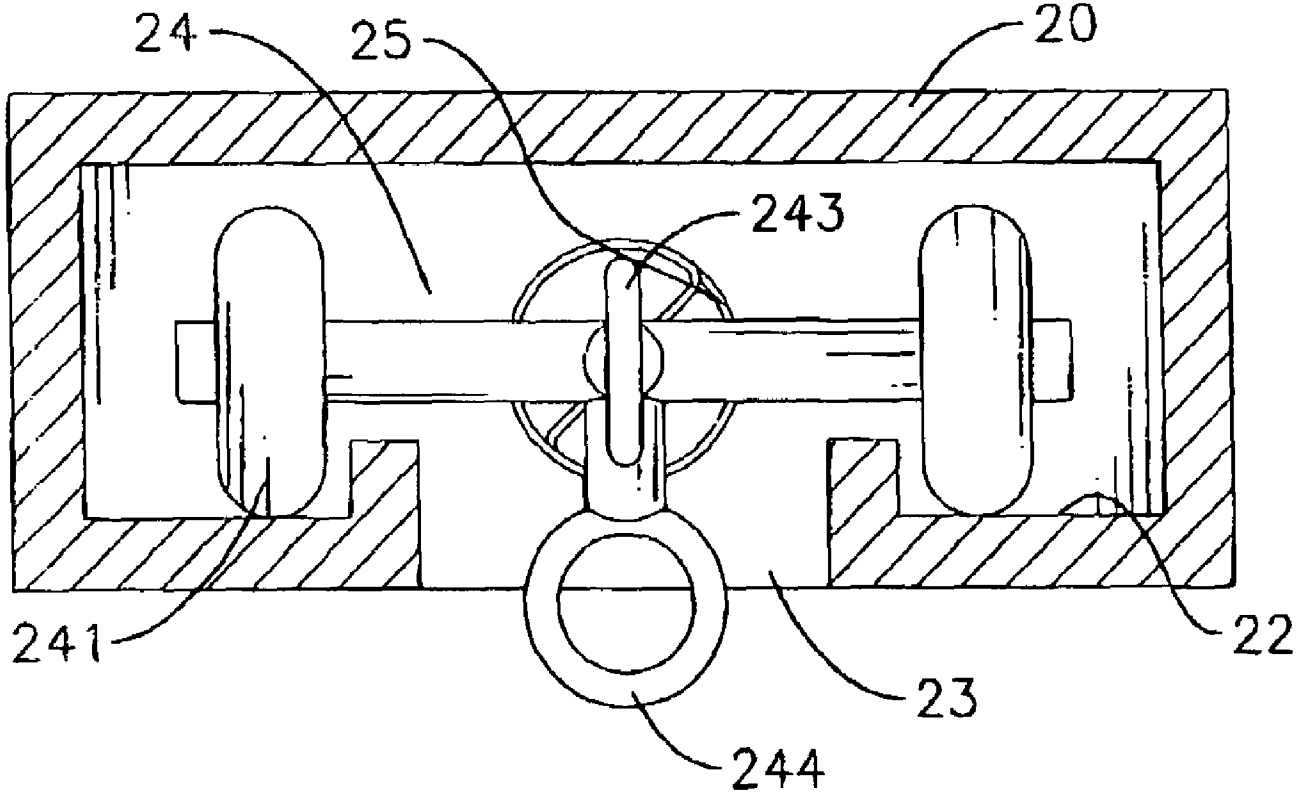
FIG. 2 is an enlarged rear view in partial section of the swimming exerciser in FIG. 1.
Figure 3:
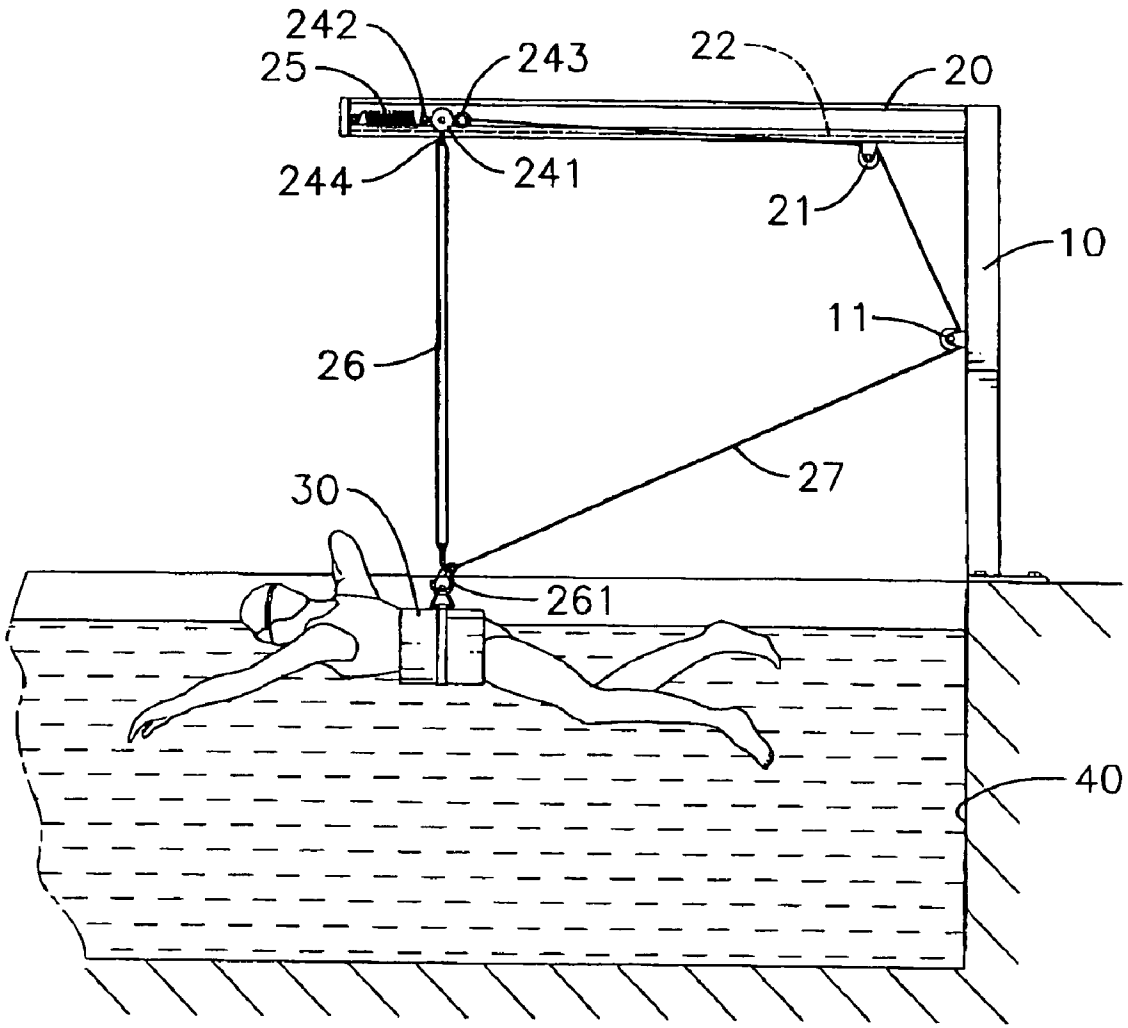
FIG. 3 is an operational side view in partial section of the swimming exerciser in FIG. 1.

With reference to FIGS. 1, 2 and 3, a swimming exerciser in accordance with the present invention comprises a vertical support (10), an arm (20), a roller assembly (241), a resilient element (25), a belt (30), a resilient tether (26) and a rope (27).

The vertical support (10) has a proximal end, a distal end and a vertical support pulley (11). The proximal end of the vertical support (10) is mounted beside a swimming pool (40). The vertical support pulley (11) is attached to the vertical support (10) between the proximal and distal ends and faces the swimming pool (40).

The arm (20) is hollow, is attached to the vertical support (10), protrudes out from the vertical support (10) over the swimming pool (40) and has a proximal end, a distal end, a bottom, a longitudinal slot (23), two roller paths (22) and an optional arm pulley (21).

The proximal end of the arm (20) is attached to the distal end of the vertical support (10).

The distal end has an inside surface.

The bottom has an inner surface.

The longitudinal slot (23) is formed through the bottom of the arm (20) and has two sides.

The roller paths (22) are formed on the inner surface of the bottom of the arm (20) on opposite sides of the longitudinal slot (23).

The arm pulley (21) is attached to the bottom of the arm (20) and near the proximal end.

The roller assembly (24) is mounted moveably inside the arm (20) and has an axle, two rollers (241), an optional front eyelet (242), an optional rear eyelet (243 and an optional bottom eyelet (244).

The axle has two ends, a front, a rear and a bottom.

The rollers (241) are mounted respectively on the ends of the axle and roll respectively in the roller paths (22) in the arm (20).

The front eyelet (242) is attached to and protrudes from the front of the axle.

The rear eyelet (243) is attached to and protrudes from the rear of the axle.

The bottom eyelet (244) is attached to and protrudes from the bottom of the axle through the longitudinal slot (23) in the arm (20).

The resilient element (25) is mounted inside the arm (20), may be a spring and has an outer end and an inner end. The outer end is connected to the inside surface of the distal end of the arm (20). The inner end is connected to the front of the axle and the front eyelet (242) of the roller assembly (24) when a front eyelet (242) is attached to the front of the axle.

The belt (30) is a loop, is worn around a person's waist and has an outer surface and a connector. The connector is mounted pivotally on the outer surface of the belt (30).

The resilient tether (26) connects the belt (30) to the roller assembly (24), compensates for a swimmer's lack of movement through the water to hold the swimmer wearing the belt (30) at a specific depth and has a proximal end, a distal end and an optional book (261). The proximal end of the resilient tether (26) is connected to the bottom of the axle and to the bottom eyelet (244) of the roller assembly (24) when a bottom eyelet (244) is attached to the axle. The distal end of the resilient tether (26) is connected to the connector on the belt (30). The hook (261) is attached to the distal end of the resilient tether (26) and is connected to the connector on the belt (30) to connect the resilient tether (26) to the belt (30).

The rope (27) is connected to the roller assembly (24), passes through the longitudinal slot (23) in the arm (20), is reeved through the arm pulley (21) and the vertical support pulley (11), is connected to the belt (30) to hold a swimmer in a fixed position when swimming and has a proximal end and a distal end. The proximal end of the rope (27) is connected to the rear of the axle of the roller assembly (24) and to the rear eyelet (243) when the axle has a rear eyelet (243). The distal end of the rope (27) is connected to the belt (30) and to the hook (261) when the hook (261) is connected to the resilient tether (26).

Figure 4:
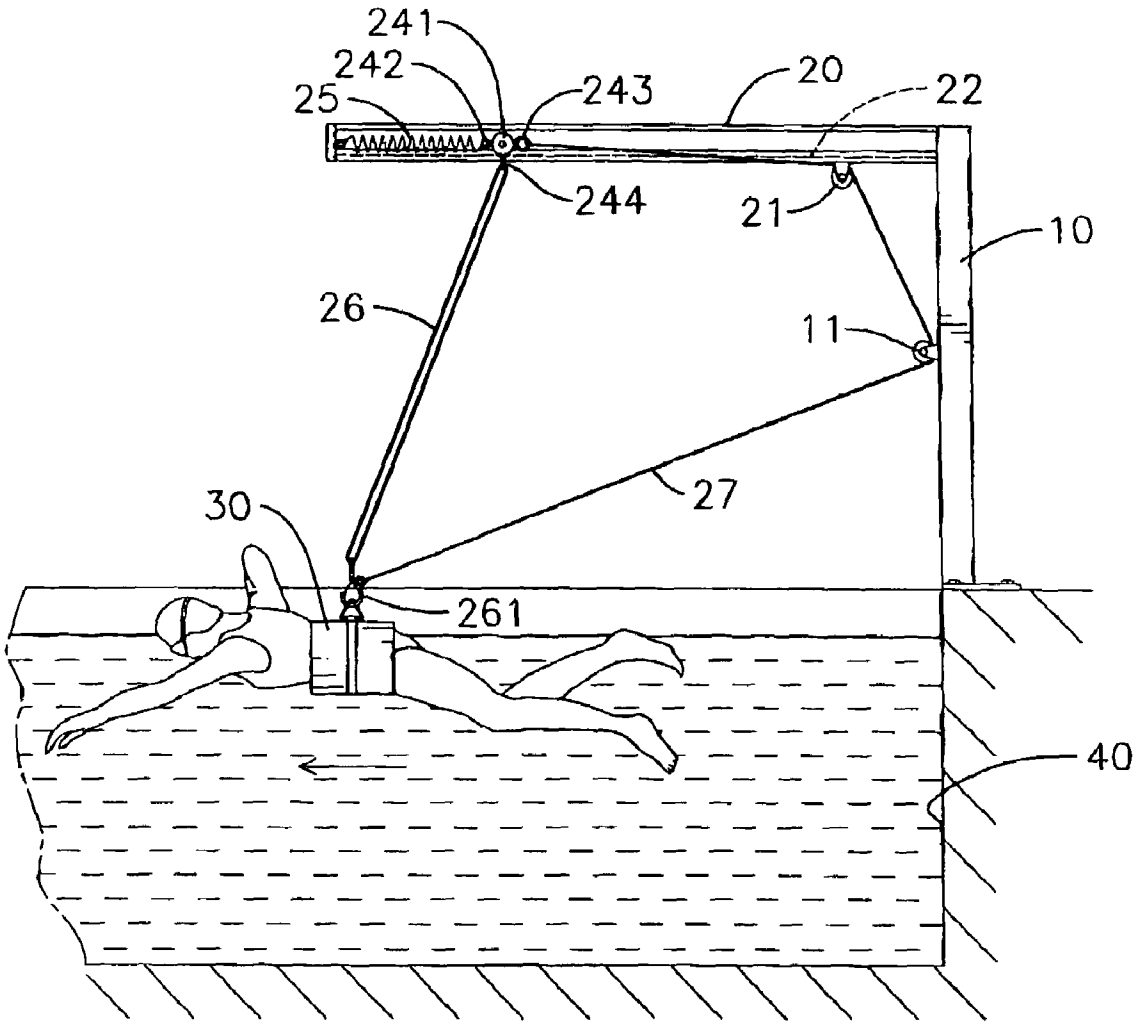
FIG. 4 is an operational side view in partial section of the swimming exerciser in FIG. 1 with a person swimming.

With further reference to FIG. 4, a person using the swimming exerciser pulls against the rope (27), the roller assembly (24) and the resilient element (25) and only moves a short distance through the water.

In conclusion, the swimming exerciser allows a person to vigorously swim and exercise in a small area of a swimming pool (40). The resilient tether (26) assists in buoying up the swimmer at a certain depth in the water, so the swimmer, especially a beginner, can swim without drowning.

Even though numerous characteristics and advantages of the present invention have been set forth in the foregoing description together with details of the structure and function of the invention, the disclosure is illustrative only. Changes may be made in detail especially in matters of shape, size, and arrangement of parts within the principles of the invention to the full extent indicated by the broad general meaning of the terms in which the appended claims are expressed.

What is claimed is:

1. A swimming exerciser comprising:

a vertical support having a proximal end adapted to be mounted beside a swimming pool;

a distal end; and a vertical support pulley attached to the vertical support between the proximal and distal ends;

an arm being hollow, attached to the vertical support, protruding out from the vertical support and having a proximal end attached to the distal end of the vertical support;

a distal end having an inside surface;

a bottom having an inner surface;

a longitudinal slot formed through the bottom of the arm and having two sides;

two roller paths formed on the inner surface of the bottom of the arm on opposite sides of the longitudinal slot;

a roller assembly mounted moveably inside the arm and having an axle having two ends;

a front;

a rear; and a bottom;

two rollers mounted respectively on the ends of the axle and rotalably received in the roller paths in the arm; and a resilient element extendably received inside the arm and having an outer end connected to the inside surface of the distal end of the arm; and an inner end connected to the front of the axle;

a belt being a loop, adapted for being worn around a person's waist and having an outer surface; and a connector mounted pivotally on the outer surface of the belt;

a resilient tether connecting the belt to the roller assembly and having a proximal end connected to the bottom of the axle; and a distal end connected to the connector on the belt; and a rope, connected to the roller assembly, passing through the longitudinal slot in the arm, reeved through the vertical support pulley and connected to the belt.

2. The swimming exerciser as claimed in claim 1, wherein the resilient tether has a hook connected to the distal end of the resilient tether, a distal end of the rope and the connector on the belt.

3. The swimming exerciser as claimed in claim 2, wherein the arm has an arm pulley attached to the bottom of the arm near the proximal end; and the rope is further reeved through the arm pulley.

4. The swimming exerciser as claimed in claim 3, wherein the roller assembly further has a front eyelet attached to and protruding from the front of the axle;

a rear eyelet attached to and protruding from the rear of the axle; and a bottom eyelet attached to and protruding from the bottom of the axle through the longitudinal slot in the arm;

the proximal end of the resilient tether is connected to the bottom eyelet of the roller assembly; and a proximal end of the rope is connected to the rear eyelet of the roller assembly.

5. The swimming exerciser as claimed in claim 4, wherein the resilient element is a spring.

* * * * *